US007491077B1

(12) United States Patent
Yang

(10) Patent No.: US 7,491,077 B1
(45) Date of Patent: Feb. 17, 2009

(54) SWITCH LAMPHOLDER

(75) Inventor: Wen Ho Yang, Taipei County (TW)

(73) Assignee: Sun-Lite Sockets Industry Inc., Taoyuan (TW)

( * ) Notice: Subject to any disclaimer, the term of this patent is extended or adjusted under 35 U.S.C. 154(b) by 0 days.

(21) Appl. No.: 12/153,295

(22) Filed: May 16, 2008

(51) Int. Cl.
*H01R 33/02* (2006.01)

(52) U.S. Cl. ..... 439/241; 439/449; 439/600; 439/615; 439/617

(58) Field of Classification Search ..... 439/220, 439/226, 229, 236, 239, 240, 241, 242, 306, 439/449, 600, 613, 615, 617
See application file for complete search history.

(56) References Cited

U.S. PATENT DOCUMENTS 6,171,135 B1 * 1/2001 Yang ..... 439/456
6,186,822 B1 * 2/2001 Yang ..... 439/457
6,287,152 B1 * 9/2001 Yang ..... 439/644
6,582,269 B2 * 6/2003 Sakai et al. ..... 445/26
7,033,220 B1 * 4/2006 Yang ..... 439/617
7,097,508 B1 * 8/2006 Yang ..... 439/617

* cited by examiner

*Primary Examiner*—James Harvey
(74) *Attorney, Agent, or Firm*—Bacon & Thomas, PLLC

(57) ABSTRACT

The invention is to provide a switch lamp holder, which comprises: a core, having a switch control element stretched from its lateral and a set of penetrating orifices which are residing at the oblique areas of the core, and joining a hollow chamber at its one end; a cover, having a through hole at its top and a hollow chamber at its bottom to conceal the core with an joint, and having a slot at its lateral to allow the passage of the switch control element; and a positioning plate, offering a set of posts at its top, capable of joining the penetrating orifices, and a set of positioning grooves, for accommodating a set of conducting spring slices, and the conducting spring slices is provided with a connecting cord to extend upward to join said core.

4 Claims, 11 Drawing Sheets

SWITCH LAMPHOLDER

BACKGROUND OF THE INVENTION

1. Field of the Invention

The present invention relates to switch lamp holders, more particularly, to one that intends to be used by an energy saving lamp.

2. Description of the Prior Art

A switch lamp holder is used to accommodate a lamp for the conduction of electricity, where a power cord is extended to connect with a power supply. The switch lamp holder carries a switch mechanism which is connected by a switch control element (knob, slide or pull-chain) that offers the user the control over the lamp either for asserting a power ON (electricity connected) or a power OFF (electricity disconnected). Prior art switch lamp holders as in FIGS. 1-6 are the majority, where the first prior art example shown in FIG. 1 is categorized into a knob switch lamp holder 60, which contains a core 62 inside an outer shell 61. The core 62 offers a power cord 63 a threaded joint on its top and the power cord passes through a cover 64 joined with the outer shell 61 and extends outward to connect with the power supply. The core 62 contains a switch mechanism (not shown in the figure), has a knob 65 at its lateral which protrudes from the outer shell 61, and joins a threaded tube shell 66 at its bottom (a relative position in FIG. 1). The threaded tube shell 66 is used to screw the threaded terminal (not shown in the figure) of a lamp in for a lodge. The knob 65 offers the user a manual control over the lamp to light up or put out by following a cyclic pattern. An insulated hollow cylinder 67 is put to segregate the outer shell 61 from the core 62 and the threaded tube shell 66 to substantially boost the safety.

The second prior art example shown in FIG. 2 is categorized into a slide switch lamp holder 60*a*, where the difference compared with the aforesaid knob switch lamp holder 60 is a push rod 65*a*, which is being pushed back and forth for asserting ON or OFF of the power by the user. The third prior art example shown in FIG. 3 is categorized into a pull-chain switch lamp holder 60*b*, where the difference compared with the aforesaid knob switch lamp holder 60 and slide switch lamp holder 60*a* is a pull-chain 65*b*, which is being pulled down in a toggle manner to assert ON and OFF of the power by the user.

The prior art examples shown in FIGS. 1-3 all have tied the power cord 63 in a knot before it stretches out from the cover 64, which the purpose is to prevent the threaded joint of the power cord 63 with the core 62 from being loosened by any accidental acts of pulling. Later, in the light of "avoid disjoining by accident", a structure "bracket" is presented to the public which is shown in FIGS. 4-6, wherein the fourth prior art example shown in FIG. 4 is the same as the knob switch lamp holder 60 shown in FIG. 1, whereas the different structure between the two is that there is no knot for the power cord 63 in FIG. 4, but a set of brackets 68 formed on the core 62 instead, offering the cord 63 a tight attachment before it extends from the cover 64, and this structure substantially avoids the possible segregation of the power cord 63 with the core 62. By the same token, both the fifth prior art example shown in FIG. 5 (the same as the slide switch lamp holder 60A shown in FIG. 2) and the sixth prior art example shown in FIG. 6 (the same as the pull-chain switch lamp holder 60B shown in FIG. 3) have a set of brackets 68 formed to offer the power cord 63 a tight attachment.

Aside from the threaded joint is a linkage between the power cord 63 and the core 62 (shown in FIGS. 1-6), another approach is by inserting a terminal of the power cord into a clamping hole, where the inserting attachment is tight and stable. The selection of the inserting attachment can also adopt the other approaches—the tying knot attachment or the bracket attachment simultaneously without a conflict. The aforesaid prior art switch lamp holders are all employed by screwing the threaded terminal of a lamp into their threaded tube shell 66; therefore, lamps to be accommodated by the threaded tube shell 66 must have compatible threaded terminal structure. Nowadays, quite many energy saving lamps abandon threaded terminal structure, but take a structure of a pair (two pieces) conducting leads stretched out from the bottom of the lamp shown in FIG. 19 instead. This kind of energy saving lamps is getting popular; unfortunately, almost all the foregoing mentioned prior art switch lamp holders fail to suit these energy saving lamps properly, which indeed makes the users feel awkward and uncomfortable. Therefore, a novel and advanced structure for the switch lamp holder is absolutely in need for the current energy saving lamps.

SUMMARY OF THE INVENTION

In the light of the instant need to improve the foregoing drawbacks, the inventor conceived the plot deeply for the present invention, through tremendous endeavor over a long time; the present invention eventually comes out.

The objective of the present invention is to provide a switch lamp holder that perfectly suits energy saving lamps with the conducting leads.

To accomplish the aforesaid objective, the switch lamp holder of the present invention comprises: a core, offering a joining with a terminal of an exterior power cord, having a switch control element stretched from its lateral, which is used to control a switch mechanism in the core to perform a cyclic function between conduction and cutoff. The core is provided with a set of penetrating orifices which are opposite to each other and resides in the oblique areas of the core, and joins a hollow chamber at its one end; a cover, possessing a through hole at its top which allows the passage of the power cord, having a hollow at its bottom which forms a chamber that conceals the core, and having a slot at its lateral to allow the passage of the switch control element; and a positioning plate, offering a set of posts at its top, which join the penetrating orifices respectively, and both are fastened by a fastener, where the plate is provided with a set of positioning grooves, for accommodating a corresponding set of conducting spring slices with an attachment. The conducting spring slices are provided with connecting cords to extend upward to join the core. The connecting cords passes through the switch mechanism and are linked to the external power cords, where the conducting spring slices are used for the electrical contact with the conducting leads of an energy saving lamp.

In the foregoing switch lamp holders, the switch control element is a knob, which combines with the switch mechanism to form a knob switch.

In the foregoing switch lamp holders, the switch control element is a chain to be pulled, which combines with the switch mechanism to form a pull-chain switch.

In the foregoing switch lamp holders, the switch control element is a sliding bar, which combines with the switch mechanism to form a slide switch.

DETAILED DESCRIPTION OF THE INVENTION

To achieve the foregoing objective of the present invention, the techniques adopted and the functions achieved are detailed described with reference to the following preferred embodiments and the accompanying drawings, which helps to arrive at a thorough comprehension.

Figure 2:
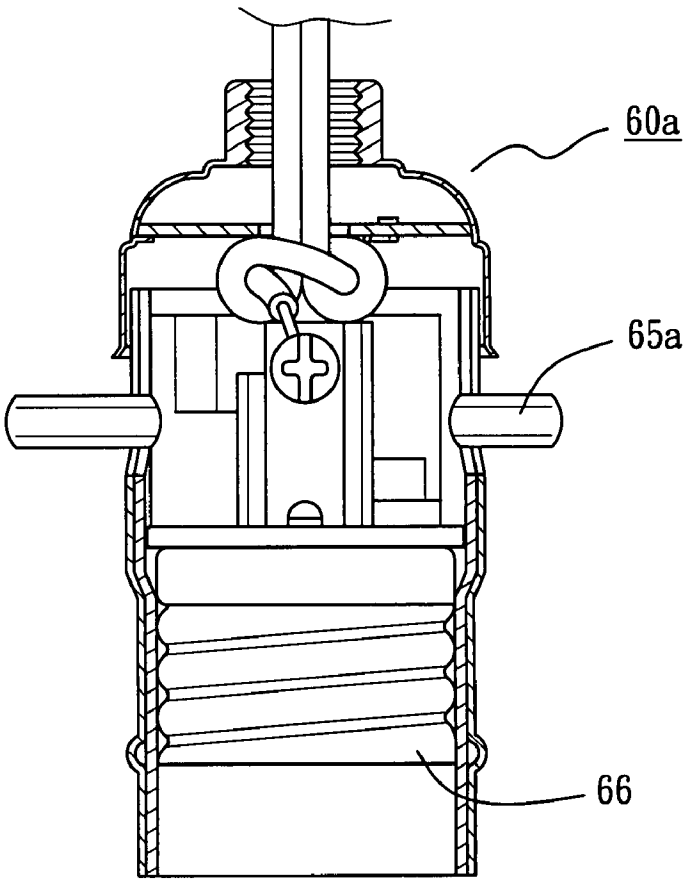
FIG. 2 (PRIOR ART)
FIG. 2 is an assembled partially sectional view to depict a prior art slide switch lamp holder.
Figure 1:
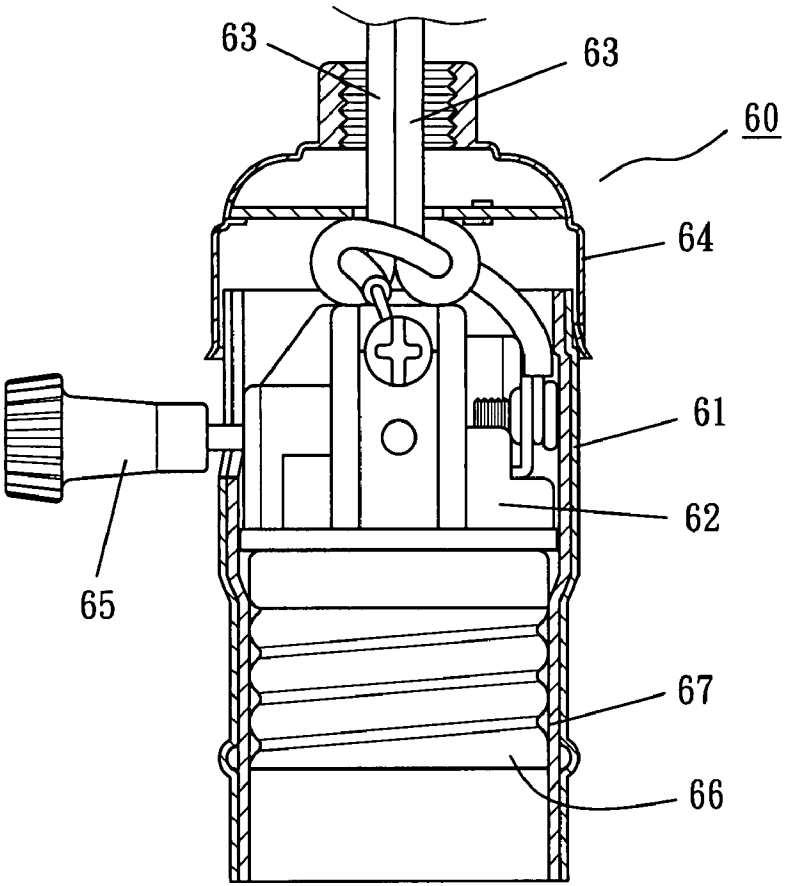
FIG. 1 (PRIOR ART)
FIG. 1 is an assembled partially sectional view to depict a prior art knob switch lamp holder.
Figure 4:
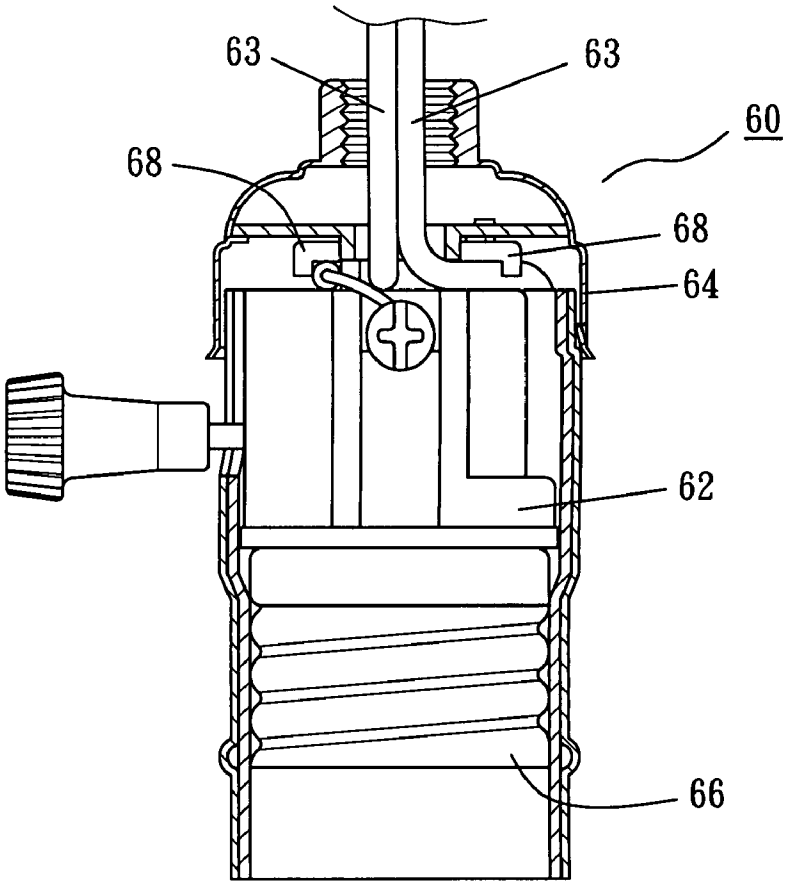
FIG. 4 (PRIOR ART)
FIG. 4 is an assembled partially sectional view to depict another prior art knob switch lamp holder.
Figure 3:
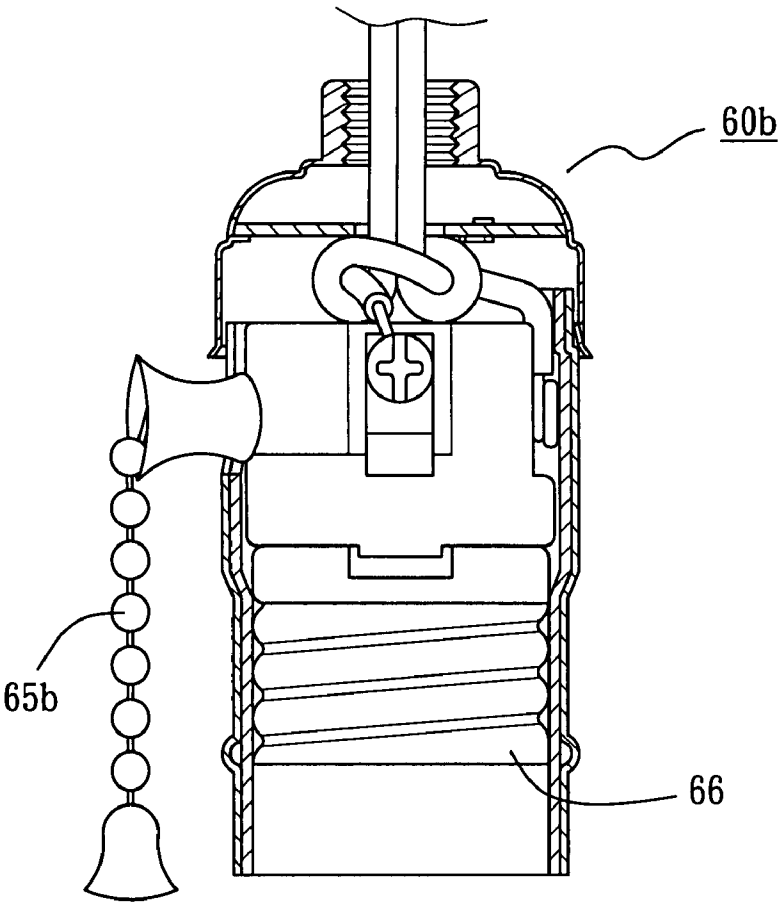
FIG. 3 (PRIOR ART)
FIG. 3 is an assembled partially sectional view to depict a prior art pull-chain switch lamp holder.
Figure 6:
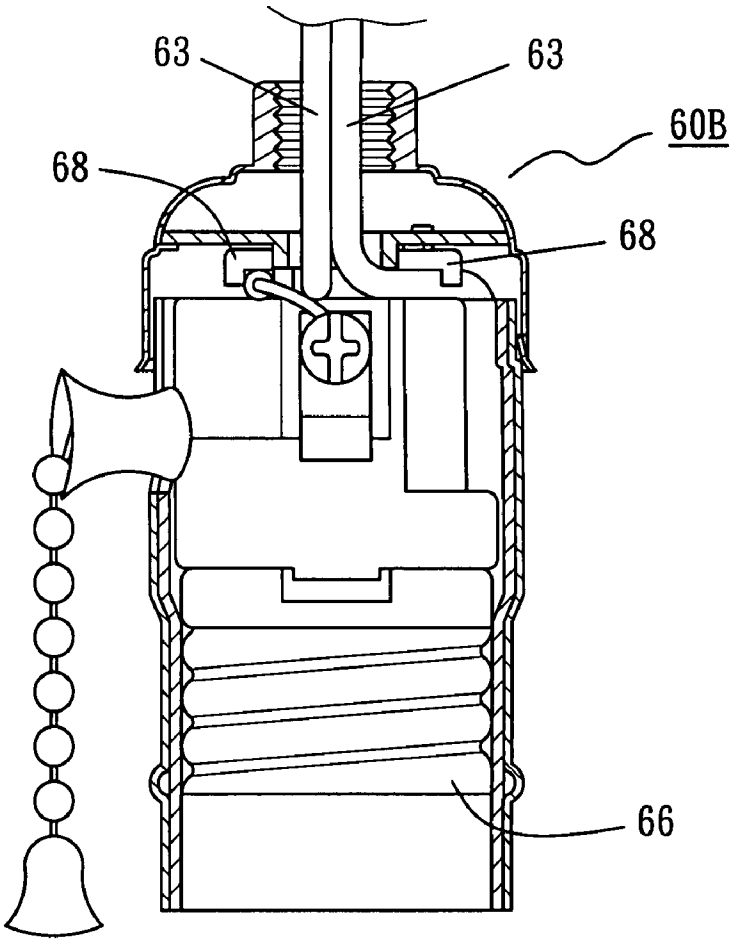
FIG. 6 (PRIOR ART)
FIG. 6 is an assembled partially sectional view to depict another prior art pull-chain switch lamp holder.
Figure 5:
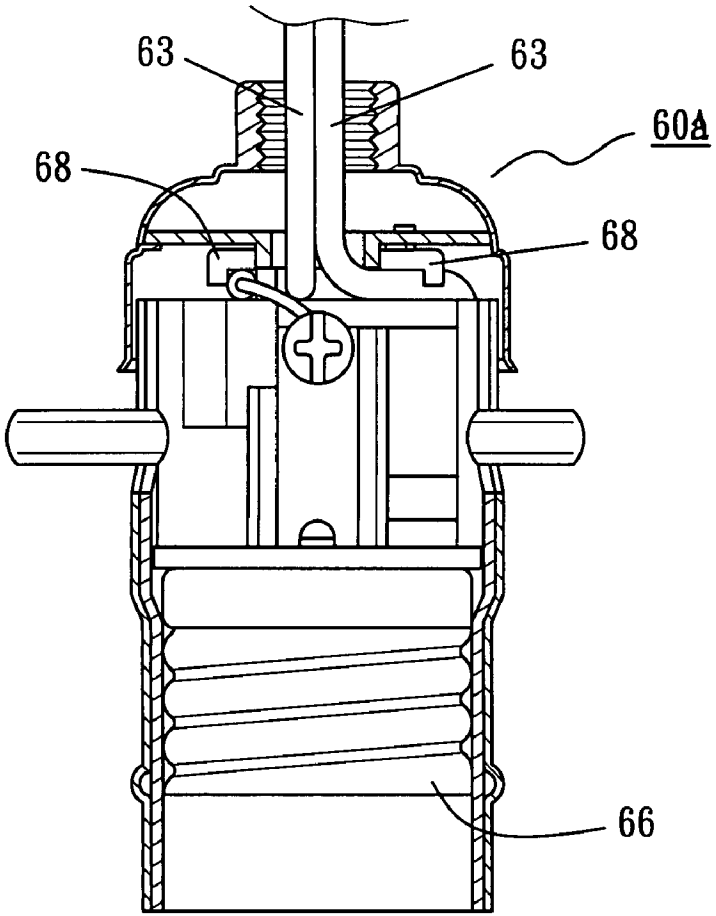
FIG. 5 (PRIOR ART)
FIG. 5 is an assembled partially sectional view to depict another prior art slide switch lamp holder.
Figure 7:
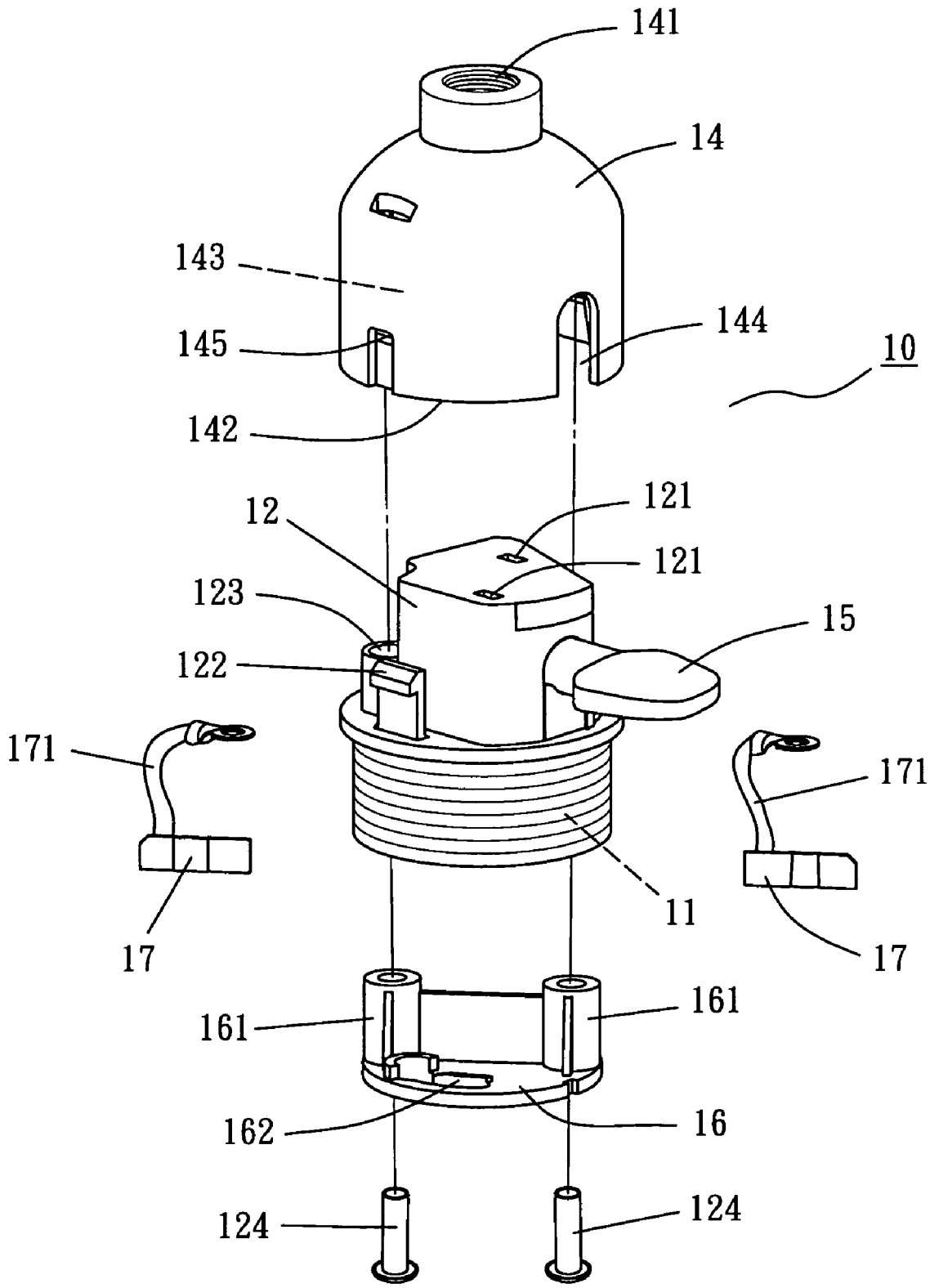
FIG. 7 is a three-dimensional exploded view to depict the knob switch lamp holder of the first exemplified embodiment of the present invention.
Figure 8:
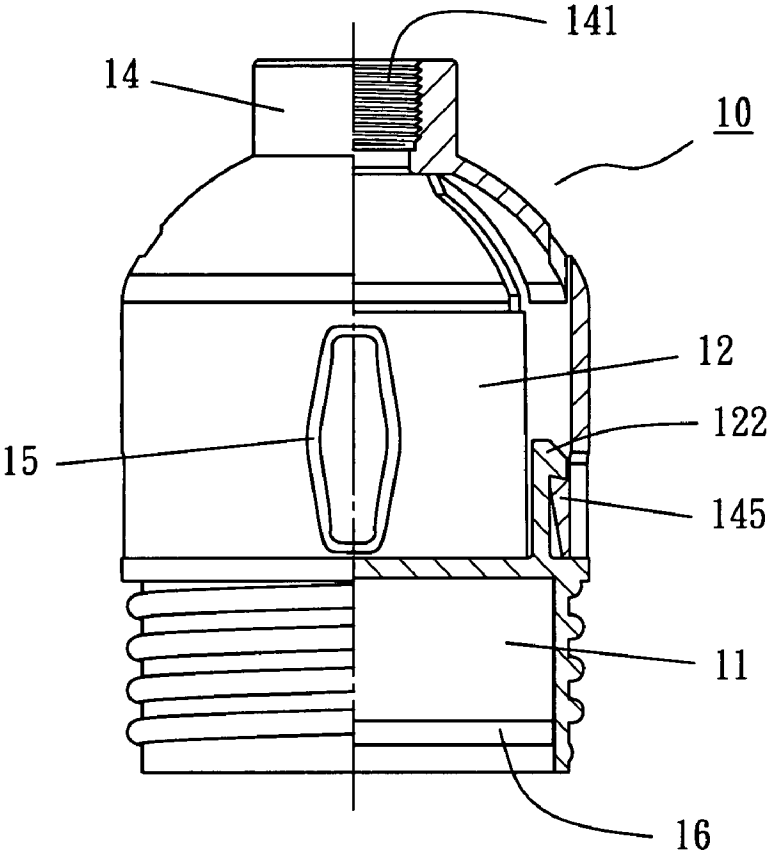
FIG. 8 is an assembled partially sectional view to depict the knob switch lamp holder of the first exemplified embodiment of the present invention.
Figure 19:
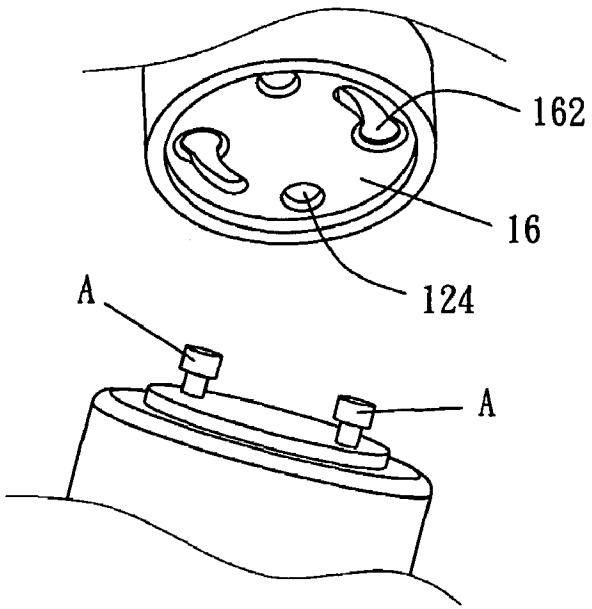
FIG. 19 is a schematic diagram to depict the joining of the switch lamp holder of an exemplified embodiment of the present invention with an energy saving lamp.

Referring to FIG. 7, the first exemplified embodiment of the present invention is a knob switch lamp holder 10, comprising a core 12, holding a set of clamping holes 121 at its top for the plug-in by a terminal of a power cord, having a knob 15 stretched from its lateral for the control of a switch mechanism (not shown in the figure) in the core 12 that performs functional shift between electric conduction, having a set of hooks 122 formed in opposite positions (displaying only one hook in FIG. 7) at its lateral, joining a hollow cavity 11 at its bottom (referring to FIG. 8), and having a set of penetrating orifices 123 (displaying only one orifice in FIG. 7) opposite to each other and resides at the oblique areas of the core 12; a cover 14, possessing a through hole 141 at its top which allows the passage of the power cord, having a bottom shaped a hollow 142 and formed upwardly into a chamber 143, having a slot 144 at its lateral to allow the passage of the shaft pole 151 of the knob 15, and a set of clasping rods 145 (displaying only one rod in FIG. 7) opposite to each other are located on the inner wall of the chamber 143, which are used for the seizing by the hooks 122 (referring to FIG. 8); and a positioning plate 16, offering a set of posts 161 at its top, which join the penetrating orifices 123 respectively, followed by a fastener 124 (for instance: rivet) for engaging a penetration and an immobile attachment, where the positioning plate 16 is provided with a set of positioning grooves 162 (displaying only one groove in FIG. 7), for accommodating a corresponding set of conducting spring slices 17 with an immobile attachment, and the conducting spring slices 17 are provided with a connecting cord 171 that extends upward to join the core 12, and further passes through the switch mechanism to join the clamping hole 121. The assembly for the knob switch lamp holder 10 of the first exemplified embodiment is first by adhering the positioning plate 16 to somewhere inside the hollow cavity 11 and near its open end (shown in FIG. 8), followed by placing the chamber 143 of the cover 14 over the core 12 and seizing the corresponding clasping rod 145 by the hook 122, to form a solid bond between the cover 14 and the core 12. When it is in use, the outside power supply is transmitted by the power cord which is guided to pass the through hole 141 into the core and is inserted into the clamping hole 121 for a tight bond. As in FIG. 19, the conducting leads A of an energy saving lamp are being placed into the positioning grooves 162 followed by a twist, to tighten the conducting leads A with the conducting spring slice 17, which enables the electric current conducted to the conducting leads. A; therefore, the switch mechanism (the knob 15 is combined with the switch mechanism to form a knob switch) can be controlled by the knob 15 for asserting a connection or a disconnection for the current flow, which further controls the power ON or OFF of the energy saving lamps.

Figure 9:
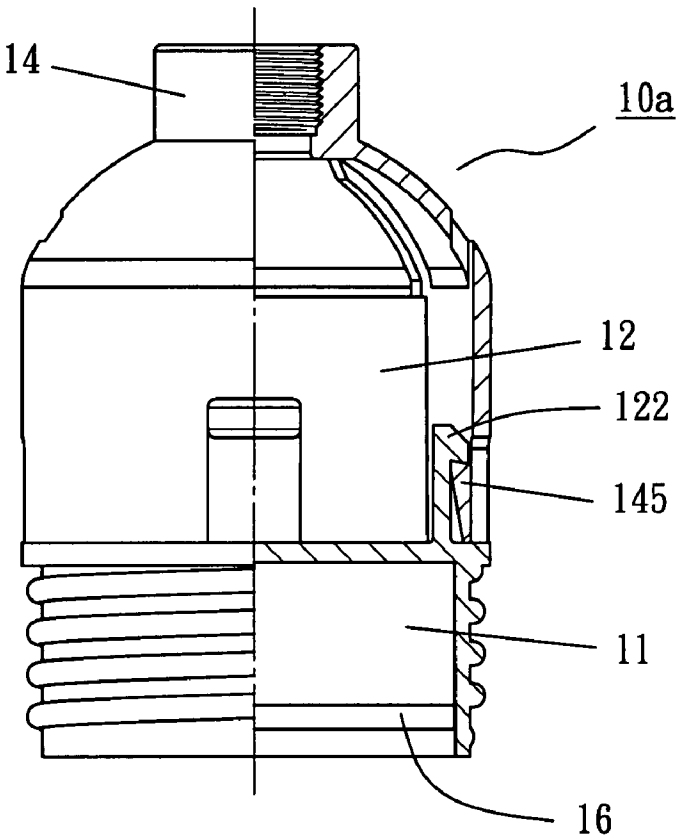
FIG. 9 is an assembled partially sectional view to depict the slide switch lamp holder of the second exemplified embodiment of the present invention.
Figure 10:
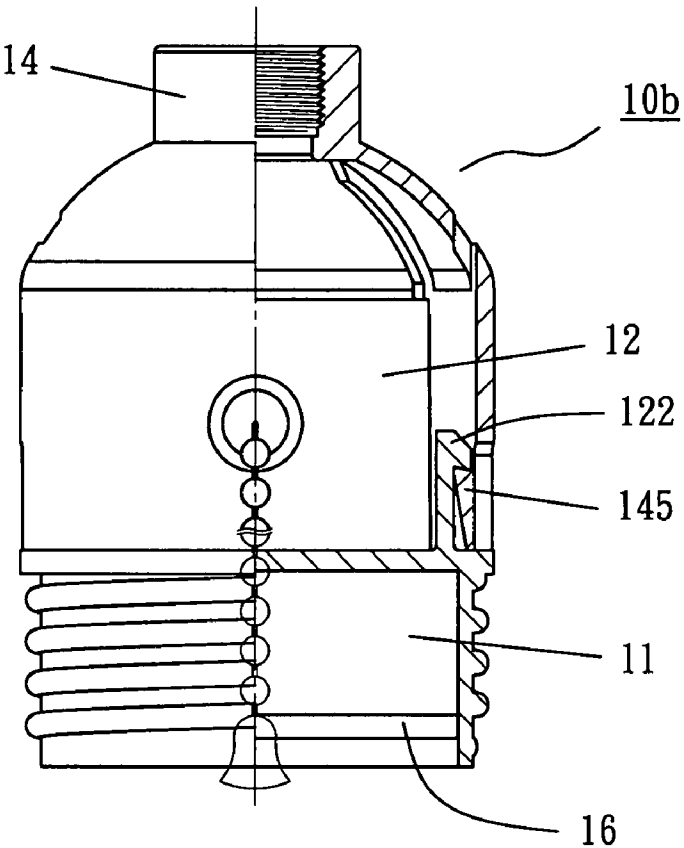
FIG. 10 is an assembled partially sectional view to depict the pull-chain switch lamp holder of the third exemplified embodiment of the present invention.

The cover 14 and the core 12 of the knob switch lamp holder 10 of the first exemplified embodiment are assembled by buckling the hook 122 with the clasping rod 145, so that it can be named as "buckled assembly" switch lamp holder. Aside from the knob switch lamp holder can be changed its assembly form into the buckled type, the slide and pull-chain switch lamp holders are also available to change into the buckled assembly structure, that is, equally to a slide switch lamp holder 10*a* and a pull-chain switch lamp holder 10*b* of the second and the third exemplified embodiments (shown in FIGS. 9&10 respectively), which the assembly are done by buckling the clasping rod 145 of the cover 14 with the hook 122 of the core 12, and the positioning plate 16 is adhering to somewhere close to the open end of the hollow cavity 11, for the electric contact for the conducting leads A of an energy saving lamp, where the same objective can provide to the energy saving lamps with conducting leads A.

Figure 12:
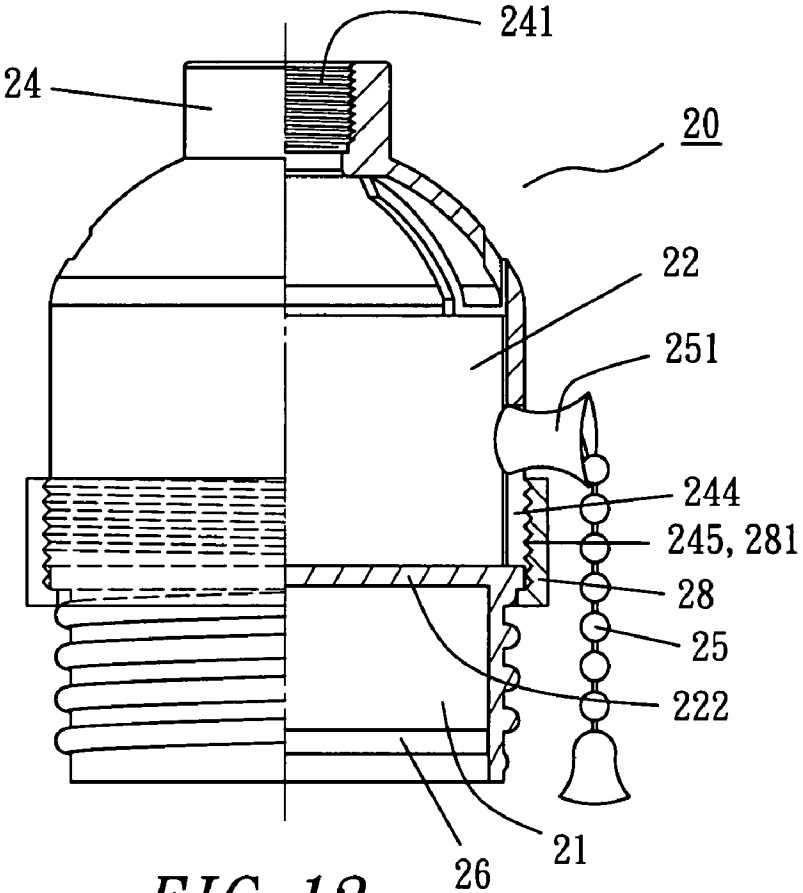
FIG. 12 is an assembled partially sectional view to depict the pull-chain switch lamp holder of the fourth exemplified embodiment of the present invention.
Figure 11:
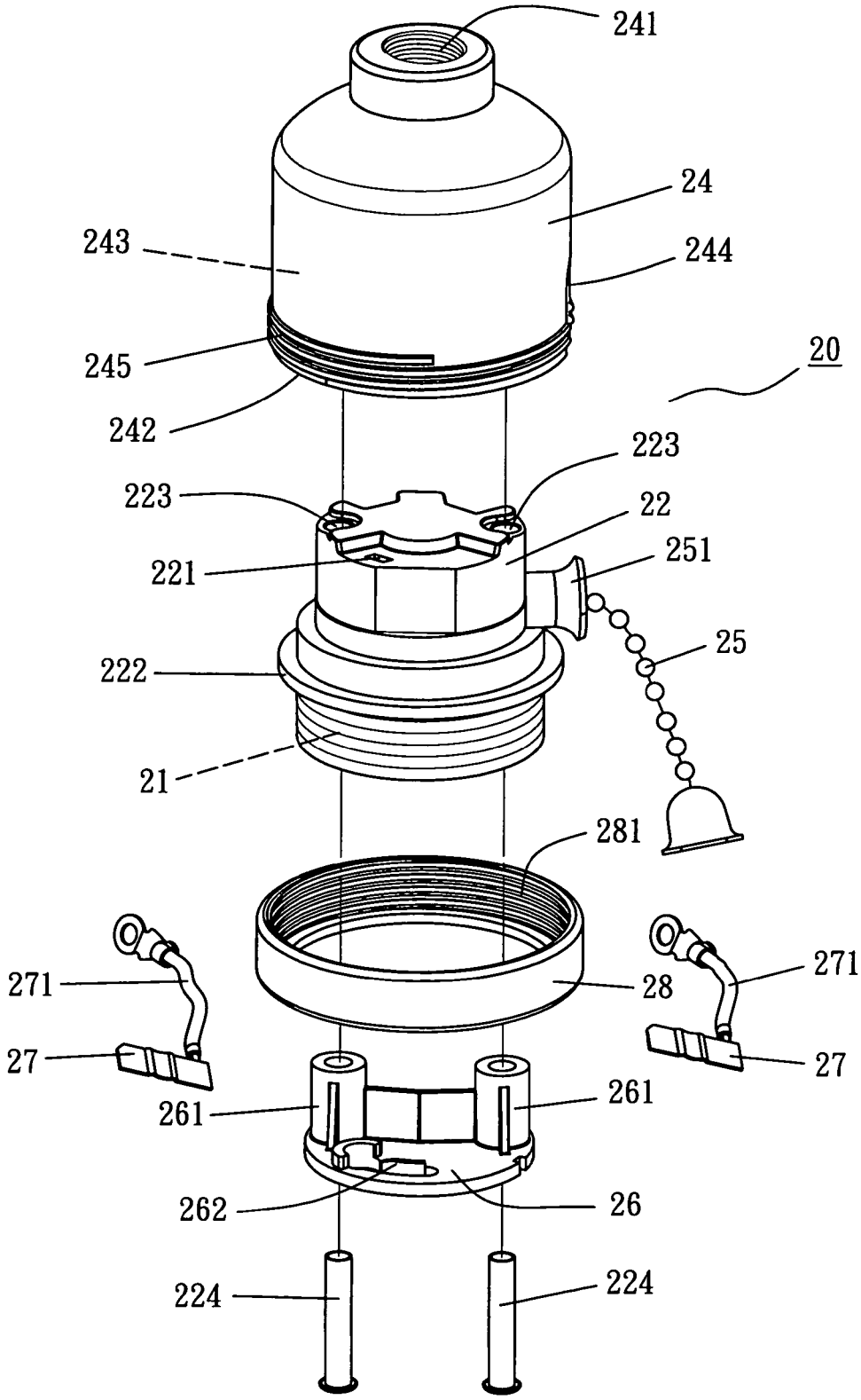
FIG. 11 is a three-dimensional exploded view to depict the pull-chain switch lamp holder of the fourth exemplified embodiment of the present invention.

The linkage between the cover 14 and the core 12 of the first through the third exemplified embodiments adopts the buckling between the hook 122 and the clasping rod 145, which is the "buckled assembly" type. Besides, it is also available to select other types of assembly structures. Referring to FIGS. 11 & 12, the fourth exemplified embodiment is an "outer threaded assembly" type of pull-chain switch lamp holder 20, comprising a core 22, having a set of clamping holes 221 at its top offering for the joining with the power cord connected to the outside power supply, holding a trumpet-shaped penetrating orifice 251 at its lateral, where a pull chain 25 extends outward for the control over the switch mechanism (not shown in the figure) in the core 22 to activate the functional shift between power ON or OFF. A protruded stiff lip 222 is formed below the core, and a hollow cavity 21 lower is connected with the stiff lip (referring to FIG. 12). A set of penetrating orifices 223 are located at the fan-shaped spaces on the core 22 and are opposite to each other; a cover 24, possessing a through hole 241 at its top which allows the passage of the power cord, having a bottom shaped a hollow 242 and formed upwardly into a chamber 243 which can shield the core 12 and jostle against the stiff lip 222, having a slot 244 at its lateral to allow the passage of the penetrating orifice 251, and outer threads 245 are set on the outer wall near the bottom; once the cover 24 shields the core 12 and jostle against the stiff lip 222, a threaded ring 28 (having inner threads 281) can be used to put on the core 22 from bottom to top at its bottom portion, and jostle against the stiff lip 222, followed by a threaded joining for its inner thread 281 with the outer thread 245 of the cover 24, to tightly clamp the stiff lip 222, which makes the core 22 and the cover 24 to form an "outer threaded assembly" joining (shown in FIG. 12); same as the first through the third exemplified embodiments, the pull-chain switch lamp holder 20 comprises a positioning plate 26, offering a set of posts 261 at its top, which join the penetrating orifices 223 respectively, followed by a fastener 224 (for instance: rivet) for engaging a penetration and an attachment, to adhere the positioning plate 26 inside the hollow cavity 21 and near the open end (shown in FIG. 12), where the positioning plate 26 is provided with a set of positioning grooves 262, for accommodating a corresponding set of conducting spring slices 27 by an attachment to its inside, and the conducting spring slices 27 are provided with connecting cords 271 extending upward to join the core 22, and passing through the switch mechanism to join the clamping hole 221, the outside power cord is guided to pass the through hole 241 of the cover 24 into the clamping hole 221 for a tight bond; therefore, the switch mechanism (the pull-chain 25 is teaming up with the switch mechanism to form a pull-chain switch) can be controlled by pulling the pull-chain 25 for asserting a connection or a disconnection between the power supply and the conducting spring slices 27.

Figure 14:
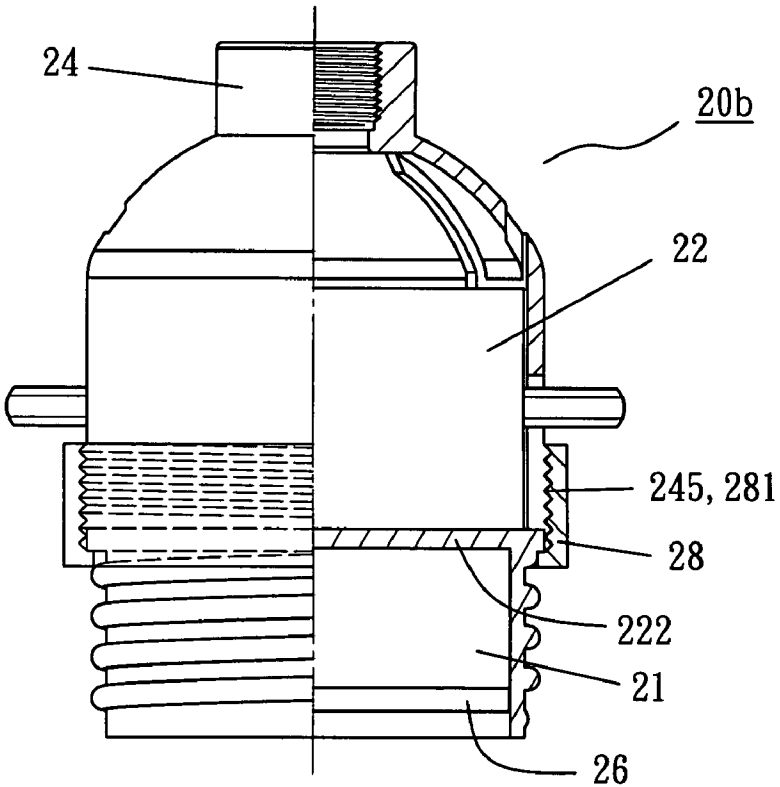
FIG. 14 is an assembled partially sectional view to depict the slide switch lamp holder of the sixth exemplified embodiment of the present invention.
Figure 13:
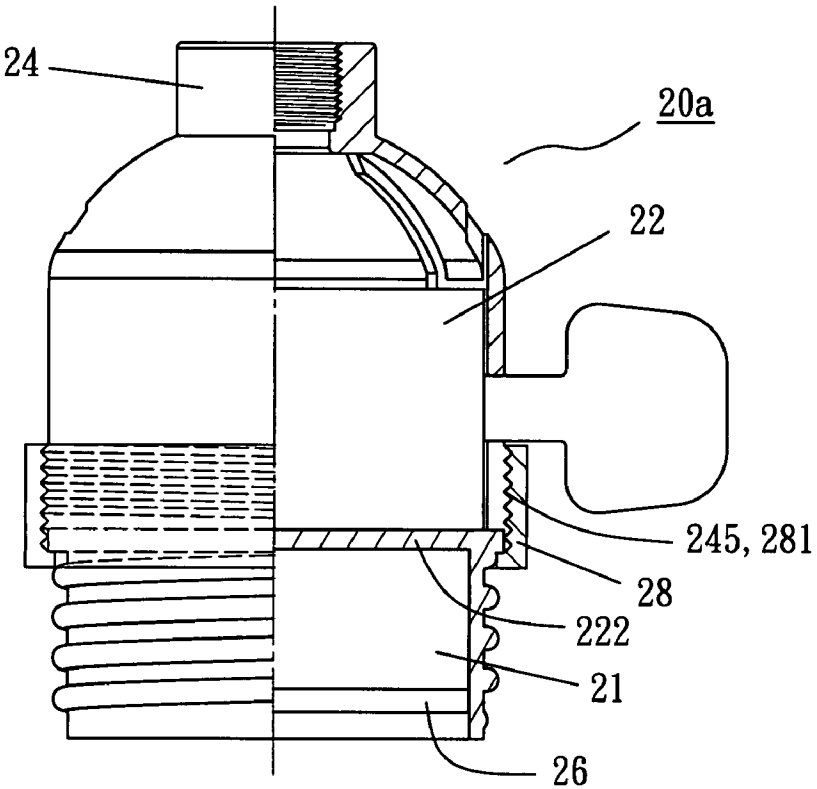
FIG. 13 is an assembled partially sectional view to depict the knob switch lamp holder of the fifth exemplified embodiment of the present invention.

The structure of the "outer threaded assembly" can also be applied to the knob switch lamp holder and the slide switch lamp holder, that is, a knob switch lamp holder 20*a* and a slide switch lamp holder 20*b* of the fifth and the sixth exemplified embodiments (shown in FIGS. 13 & 14 respectively), as usual, the cover 24 is used to shield the core 22 and to jostle against the stiff lip 222, a threaded ring 28 having inner threads 281 can be used to put on the core 22 from bottom to top at its bottom portion, and to jostle against the stiff lip 222, followed by a threaded joining for its inner thread 281 with the outer thread 245 of the cover 24, to tightly clamp the stiff lip 222, which makes the core 22 and the cover 24 to form an "outer threaded assembly" joining. No matter it is a pull-chain switch lamp holder 20, a knob switch lamp holder 20*a*, or a slide switch lamp holder 20*b*, it is the same that the conducting spring slice 27 fixed in the positioning groove 262 of the positioning plate 26 provides the joining for the conducting leads of an energy saving lamp, which fulfills in providing the same offerings in using to the energy saving lamps with conducting leads A.

Figure 15:
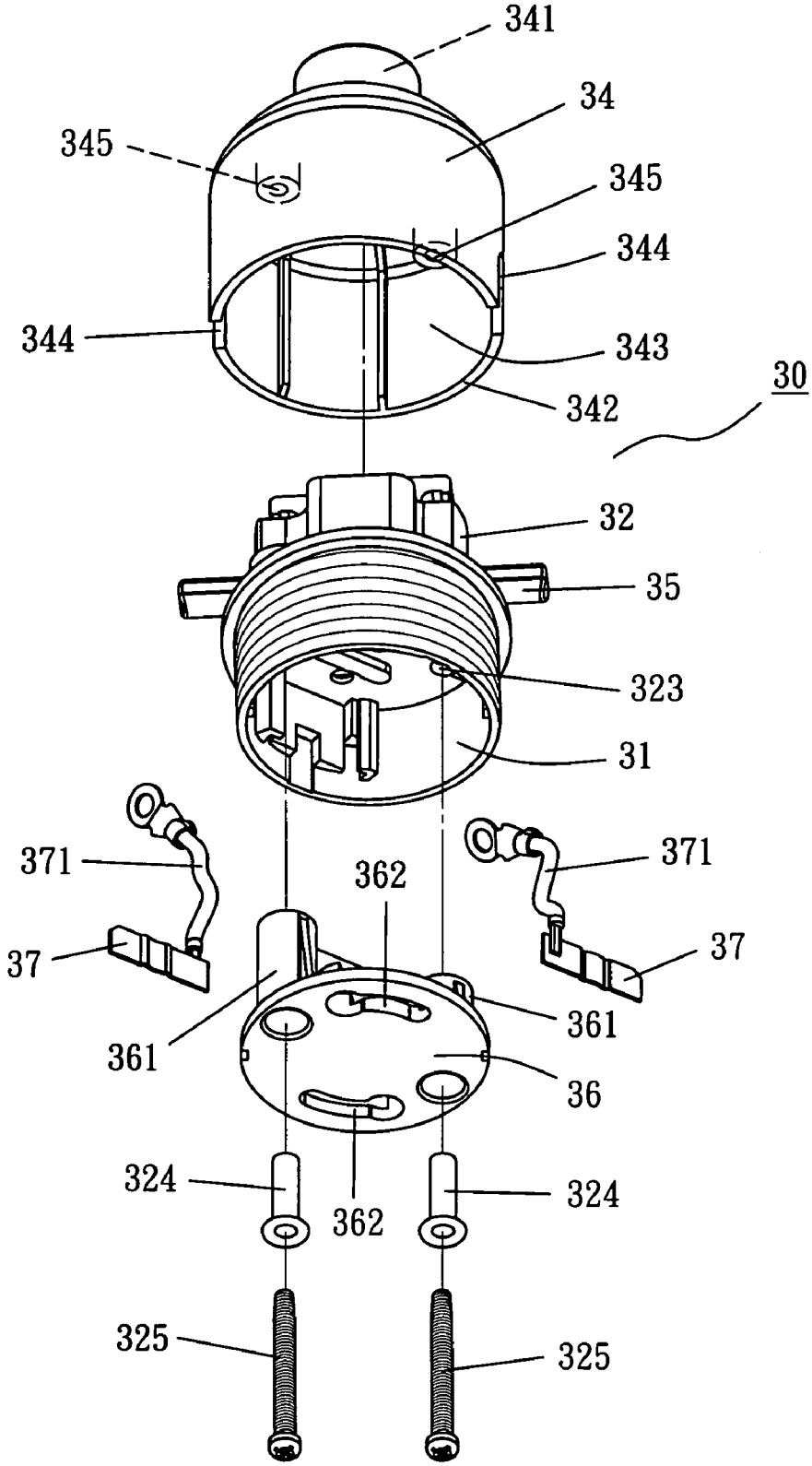
FIG. 15 is a three-dimensional exploded view to depict the slide switch lamp holder of the seventh exemplified embodiment of the present invention.
Figure 16:
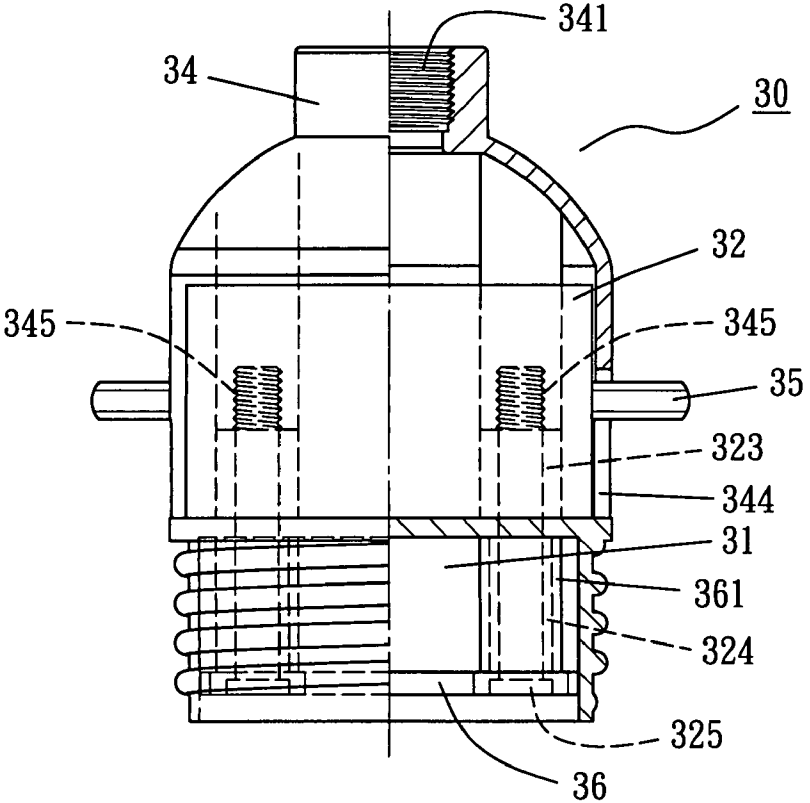
FIG. 16 is an assembled partially sectional view to depict the slide switch lamp holder of the seventh exemplified embodiment of the present invention.

Aside from the "buckled assembly" structure of the first through to the third exemplified embodiments and "outer threaded assembly" structure of the fourth through to the sixth exemplified embodiments, it is also available to adopt "inner threaded assembly" structure. Referring to FIGS. 15 & 16, for a slide switch lamp holder 30 of the seventh exemplified embodiment, which comprises a core 32, having a set of clamping holes (not shown in the figure) at its top, provided for the joining with the power cord connected to the outside power supply, holding a push rod 35 at its lateral, which extends outward from both sides of the core 32, to control the switch mechanism (not shown in the figure) in the core 32 that activates the switching of connection or disconnection. A hollow cavity 31 lower is connected with the bottom of the core 32, and a set of penetrating orifices 223 are located at the fan-shaped spaces on the core 32 and are opposite to each other; a cover 34, possessing a through hole 341 at its top which allows the passage of the power cord, having a bottom shaped a hollow 342 and formed upwardly into a chamber 343 which can shield the core 32, having a set of slots 344 at its both sides to allow the passage of the push rod 35, and a set of threaded holes 345 are set on the top of the inner wall of the chamber 343 which has inner threads; a positioning plate 36, offering a set of posts 361 at its top, which join the penetrating orifices 323 respectively, followed by a fastening sleeve 324 (for instance: rivet) for engaging a penetration and an attachment, to adhere the positioning plate 36 inside the hollow cavity 31 and near the open end. The cover 34 is then used to shield the core 32 and a threaded element 325 is used to put on the fastening sleeve 324 from bottom to top, followed by a threaded joining with the threaded hole 345 of the chamber 343, to tightly clamp the stiff lip 222, which places the positioning plate 36, the core 32, and the cover 34 together for an assembly (shown in FIG. 16). Equivalent to the first through to the sixth exemplified embodiments aforesaid, the positioning plate 36 is provided with a set of positioning grooves 362, for accommodating a corresponding set of conducting spring slices 37 for an attachment to its inside, and the conducting spring slices 37 are provided with connecting cords 371 extending upward to join the core 32, and passing through the switch mechanism to join the clamping hole, the outside power cord is guided to pass the through hole 341 of the cover 34 into the clamping hole for a tight bond; therefore, the switch mechanism (the push rod 35 is together with the switch mechanism to form a slide switch) can be controlled by pushing the push rod 35 for asserting a connection or a disconnection between the power supply and the conducting spring slices 37.

Figure 17:
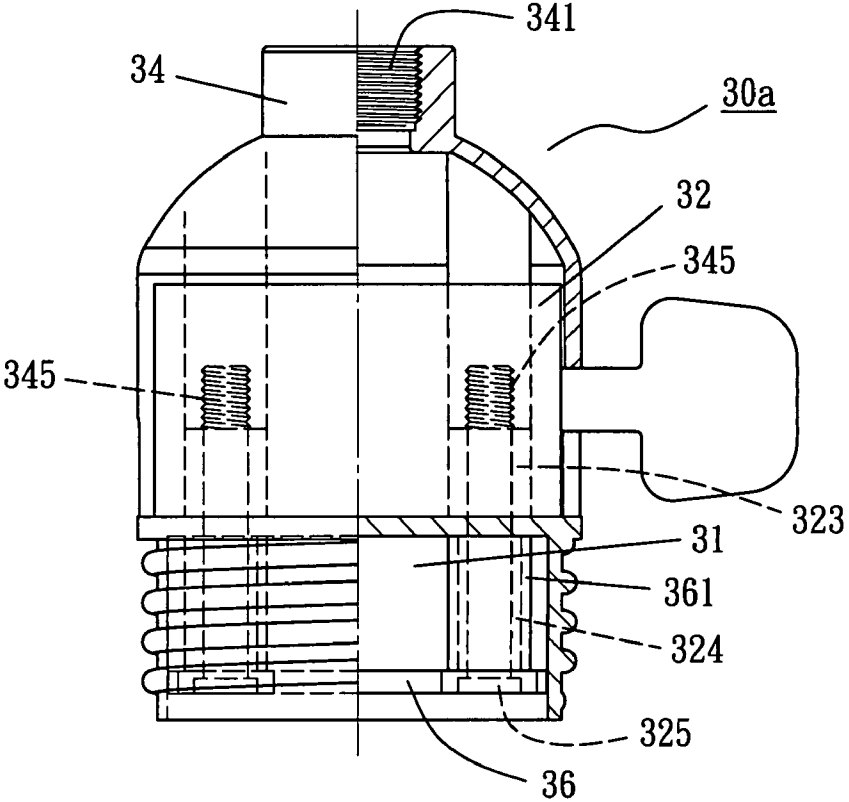
FIG. 17 is an assembled partially sectional view to depict the knob switch lamp holder of the eighth exemplified embodiment of the present invention.
Figure 18:
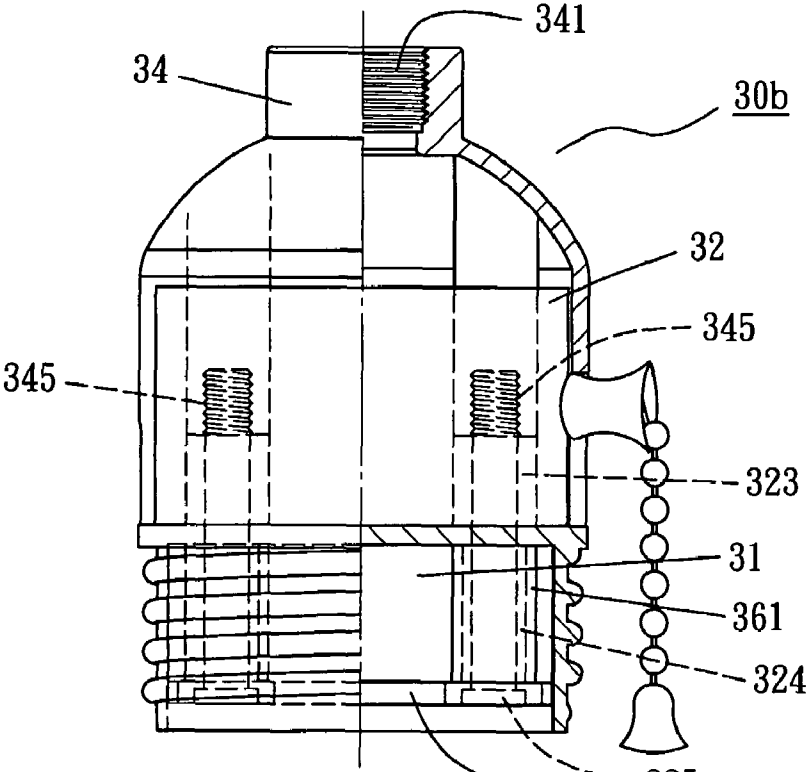
FIG. 18 is an assembled partially sectional view to depict the pull-chain switch lamp holder of the ninth exemplified embodiment of the present invention.

The structure of the "inner threaded assembly" can be applied to the knob switch lamp holder 30*a* and the pull-chain switch lamp holder 30*b* of the eighth and the ninth exemplified embodiments shown in FIGS. 17 & 18 respectively, the fastening sleeve 324 for engaging a penetration through a post 361 and a penetrating orifice 323, to adhere the positioning plate 36 inside the hollow cavity 31 and near the open end, taking the over 34 conceal the core 32, followed by having the threaded element 325 pierces through the fastening sleeve 324 and joins the threaded hole 345 in the chamber 343, integrating the cover 34, the core 32, and the positioning plate 36 to carry out "inner threaded assembly" joining. No matter it is a slide switch lamp holder 30, a knob switch lamp holder 30*a*, or a pull-chain switch lamp holder 30*b*, it is the same that the conducting spring slice 37 fixed in the positioning groove 362 of the positioning plate 36 provides the joining for the conducting leads A of an energy saving lamp, which fulfills in providing the offerings in using to the energy saving lamps with conducting leads A.

The major change of the present invention in connection with the switch lamp holders lie in that a positioning plate is adhered to the open end of the hollow cavity, where the positioning plate is provided with a set of positioning grooves, accommodating a set of conducting spring slices for an attachment, and the conducting spring slices, and the conducting spring slices are provided with connecting cords which joins the switch mechanism in the core of the switch lamp holder, where the conducting spring slices offer the joining for the conducting leads A of energy saving lamps. Despite the switch lamp holder is a knob, slide or pull-chain type, they can carry out the same change. Whether the structure of the core for the joining with the outside power cord is a threaded type or a inserted type, and whether there is a "bracket" to tighten the power cord, are all covered in the claim of the present invention; likewise, whether the linkage between the cover and the core is a "buckled assembly", a "outer threaded assembly", or a "inner threaded assembly", are all claimed by the present invention.

To sum up, the disclosed switch lamp holder of the present invention was not known to the public, and is absolutely novel. It surely can accomplish the expected inventive objective and function of offering the linkage and the usage of the energy saving lamp in the present invention, which is construed as novelty and usefulness that is compliant to the requirements of a utility patent, and an application is then filed according to the U.S. patent Statue, which deserves your favorable examination and approval.

What is claimed is:

1. A switch lamp holder, comprising:

a core, offering a joining thereon with a terminal of an exterior power cord, having a switch control element stretched from its lateral issuing a control over a switch mechanism in said core to perform functional shift between conduction or cutoff, and said core being provided with a set of penetrating orifices which are opposite to each other and residing at the oblique areas of said core, and joining a hollow chamber at its one end;

a cover, having a through hole at its top allowing the passage of the power cord, having a hollow chamber at its bottom to conceal said core with an joint, and having a slot at its lateral to allow the passage of the switch control element; and a positioning plate, offering a set of posts at its top, capable of joining the penetrating orifices respectively, followed by a fastening with a fastener, where said positioning plate is provided with a set of positioning grooves, for accommodating a corresponding set of conducting spring slices with an immobile attachment, and the conducting spring slices being provided with a connecting cord to extend upward to join said core, where the connecting cord passes through the switch mechanism and connects to the external power cord, and the conducting spring slices being used for the electrical contact with the conducting leads of an energy saving lamp.

2. A switch lamp holder according to claim 1 wherein the switch control element is a knob which combines the switch mechanism to form a knob switch.

3. A switch lamp holder according to claim 1 wherein the switch control element is a chain which combines the switch mechanism to form a pull-chain switch.

4. A switch lamp holder according to claim 1 wherein the switch control element is a sliding bar which combines the switch mechanism to form a slide switch.

* * * * *